US005366099A

United States Patent [19]

Schmid

[11] Patent Number: 5,366,099

[45] Date of Patent: Nov. 22, 1994

[54] ADJUSTABLE DISPLAY UNIT

[75] Inventor: Michael Schmid, Black Rock, Conn.

[73] Assignee: Consumer Promotions, Inc., Mount Vernon, N.Y.

[21] Appl. No.: 190,662

[22] Filed: Feb. 2, 1994

[51] Int. Cl.[5] ..... A47F 5/00

[52] U.S. Cl. ..... 211/59.3; 211/184; 211/194; 211/175; 312/71

[58] Field of Search ..... 211/59.3, 59.2, 175, 211/184, 194; 312/71, 72, 42, 45

[56] References Cited

U.S. PATENT DOCUMENTS 4,460,096 7/1984 Ricci ..... 211/184

4,685,574 8/1987 Young et al. ..... 211/184 X 4,901,869 2/1990 Hawkinson et al. ..... 211/59.3

5,069,349 12/1991 Wear et al. ..... 211/59.3

5,111,942 5/1992 Bernardin ..... 211/59.3

5,265,738 11/1993 Yablans et al. ..... 211/59.3

*Primary Examiner*—Robert W. Gibson, Jr.

*Attorney, Agent, or Firm*—Bauer & Schaffer

[57] ABSTRACT

The tray assembly includes a body having a front end portion, a rear end portion, a base and a pair of side walls disposed at right angles to the base. An adjusting assembly is associated with the base and the side walls to adjust the horizontal width of the tray assembly so as to accommodate merchandise products of various widths.

16 Claims, 3 Drawing Sheets

FIG. 1
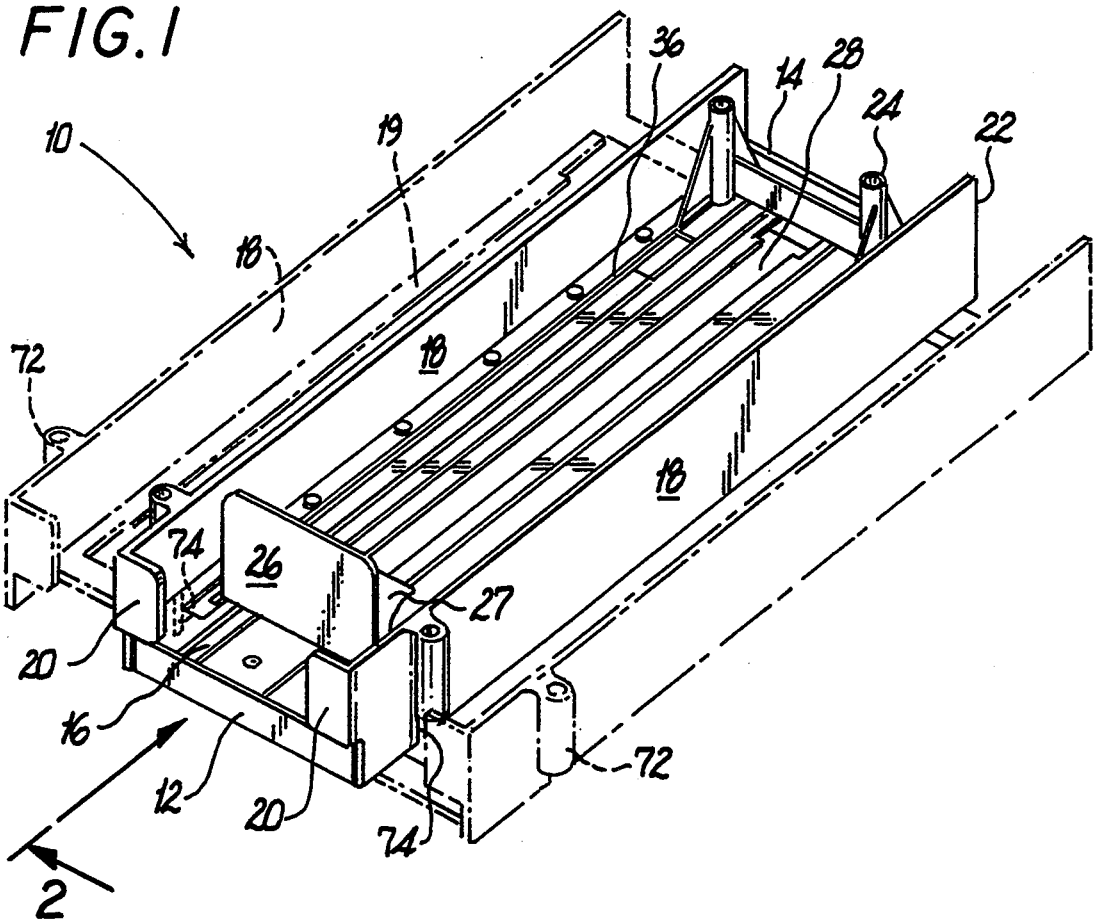
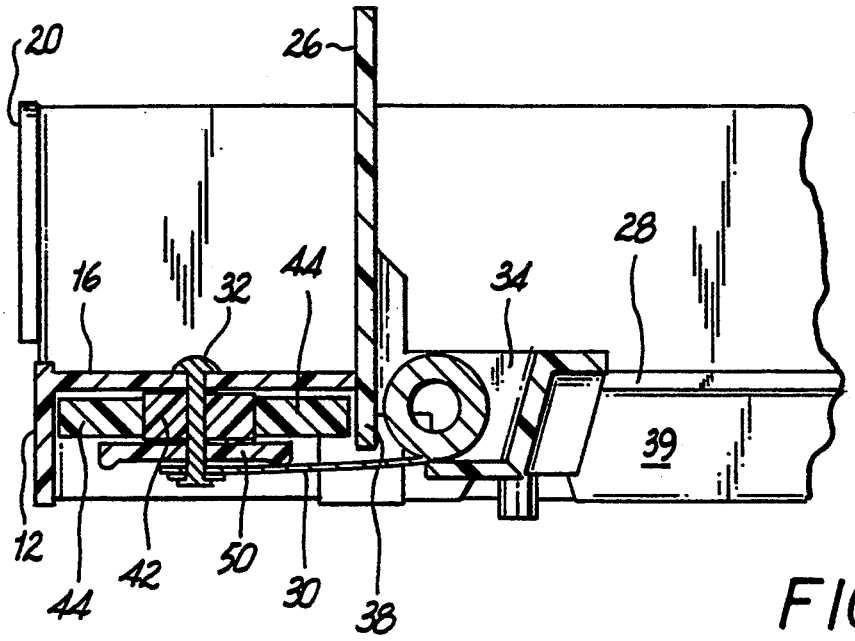
FIG. 2

ADJUSTABLE DISPLAY UNIT

FIELD OF THE INVENTION

The present invention relates generally to an assembly for storing and displaying products and, more particularly, to an expandable tray assembly for storing merchandise products from which purchasers can select and remove one or more of the merchandise products from the expandable assembly.

BACKGROUND OF THE INVENTION

In the retail sales industry, there is often a need to display a supply of products for selection and purchase by consumers. Various prior art display units have been used for this purpose, such as display cases, racks, hangers and open shelves.

Many problems are associated with the above-mentioned display units. One of these problems involves the inability of these prior art display units to position products in a manner in which the products are continually facing the consumer after the consumer removes the front products from the display unit. As with horizontal open shelves, for example, certain products located toward the back of the shelves may not be reached or even viewed by consumers as the products at the front are removed. The result is that it is required to manually move the products toward the front of the shelves in order to continue to properly display the products to the consumer in order to achieve desired merchandising and marketing effects. This process is very time-consuming and can be quite expensive.

Another problem associated with the above-mentioned display units is that the products tend to become misaligned from their desired location and thus fail to satisfy the desirability to maintain the display unit in an organized fashion so that it presents an orderly and attractive appearance.

Display units which automatically maintain merchandise products in the front of the display unit even after a product that has been in the front of the merchandiser assembly has been removed are available. However, these types of display units are not horizontally adjustable so as to permit the accommodation of merchandise products of various widths. Another disadvantage with the above-mentioned display unit is that there are no provisions for vertically stacking such display units such that a substantial number of merchandise products may be displayed in a relatively smaller area than has been possible with the above-mentioned display units.

The present invention overcomes the disadvantages inherent in the above-mentioned prior art product display units of providing an expandable tray assembly comprising display units which maintain merchandise products in a generally horizontal stacked orientation in a manner by which the front of the stack of products is automatically maintained in the front of the tray assembly even after a product that has been in the front of the tray assembly has been removed. Thus, the expandable tray assembly of the present invention will properly display merchandise products so that it presents an orderly and attractive appearance and achieve desired merchandising and marketing effects.

Another practical advantage of the present invention is that the tray units are adjustable in the horizontal, i.e., transverse, direction so as to accommodate merchandise products of various widths. Yet another advantage of the present invention is that the tray units may be stacked in a vertical direction providing an expandable tray assembly which can display a substantial number of merchandise products with a minimum amount of space.

SUMMARY OF THE INVENTION

Briefly stated, the present invention comprises an expandable tray assembly for use in storing and displaying products. In one embodiment, the tray assembly comprises an adjustable tray unit including a main body having a front end portion, a rear end portion, a base having a product support surface and a pair of side walls disposed at right angles to the base and being adjustable toward and away from each other to accommodate products of varying widths. The adjusting means compresses a tooth shaft or rack extending perpendicularly from each end of each side wall engaging, in respective pairs, a tooth wheel. As a result of the movement of one side wall simultaneously and in equal increments moves the opposite side wall.

The tray unit also includes a stop member at the front end portion of the main body for preventing the products from exiting the tray unit and a generally upstanding product follower member slidably mounted with respect to the base for movement between the rear end portion and the front end portion of the main body. The tray unit is provided with stacking members for securing the tray unit to other similar tray units to form a vertical tray assembly.

Full details of the present invention are set forth in the following description of the invention.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 1 is a perspective view of an adjustable tray unit in accordance with the present invention;

FIG. 2 is a cross-sectional view of the tray unit shown in FIG. 1 taken along the longitudinal center line of the tray shown in FIG. 1;

DETAILED DESCRIPTION OF PREFERRED EMBODIMENTS

Figure 3:
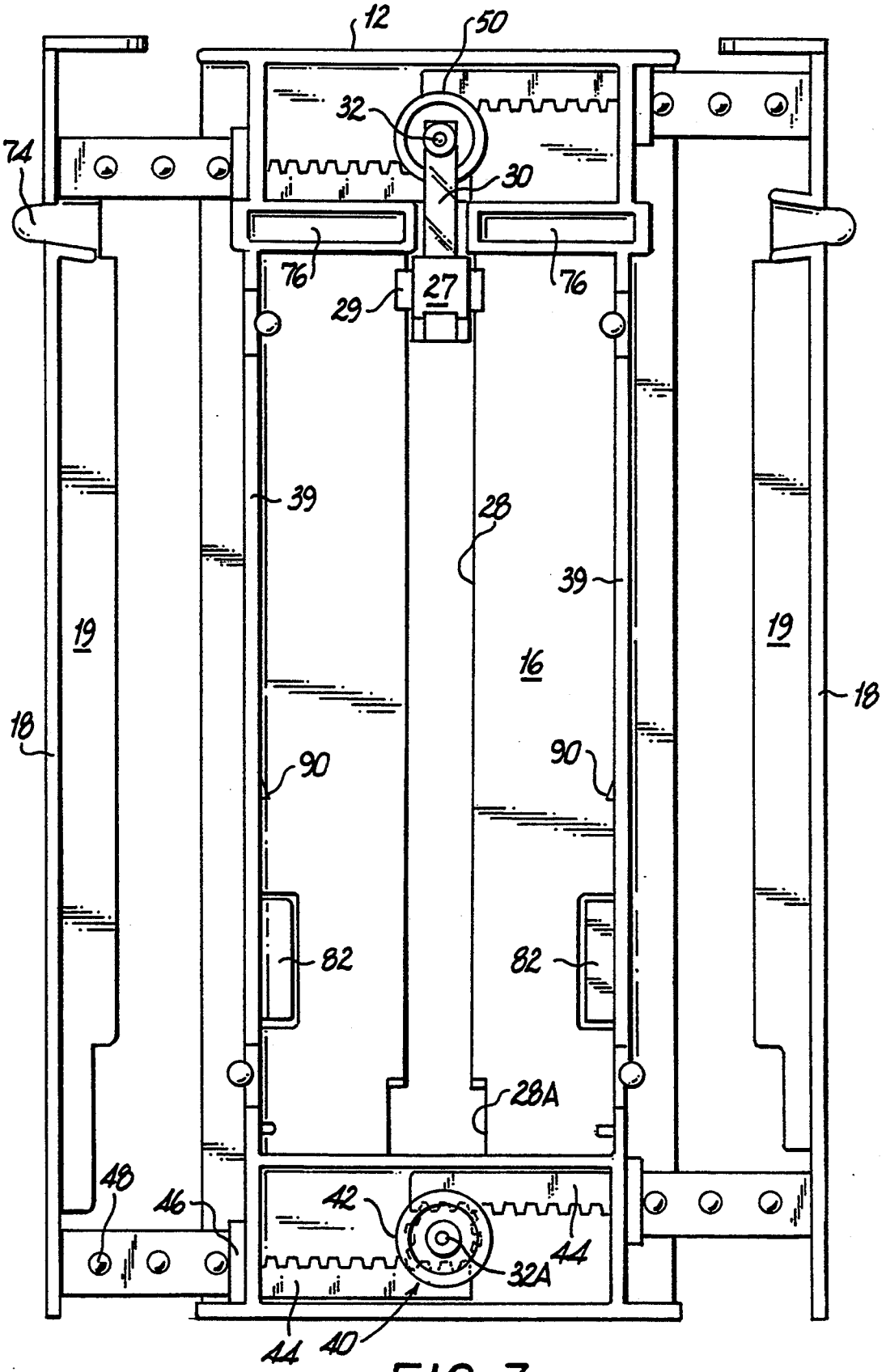
FIG. 3 is a bottom view of the tray unit shown in FIG. 1 illustrating the adjusting device for the side walls in accordance with the present invention.

Referring now to the drawings in detail, wherein like numerals are used to indicate like elements throughout, there is shown an adjustable tray unit, generally designated 10, for use in storing and displaying merchandise products (not shown). The merchandise products to be stored and displayed by the tray unit 10 have not been shown for purposes of visual clarity, but may include, for example, deodorant packages, lozenge packages, sundry products containers, such as lipstick containers and/or individual packages of cigarettes. The products may have many different shapes and sizes as is well known in the art.

The adjustable tray unit generally depicted by the numbered 10 comprises a generally elongated trough-like body having a front end portion 12, a rear end portion 14, a base 16 for supporting the merchandise products and a pair of laterally adjustable side walls 18 disposed at right angles to the base 16. The side walls 18 each have a vertical wall 20 at their front ends and a straight edge 22 at their rear ends respectively and an inwardly directed bottom platform 19. Located at the rear end portion 14 of the tray unit 10 is a pair of hollow posts 24 extending upwardly respectively at right angles from the base 16. Posts 24 and the front vertical walls 20 prevent the merchandise products from exiting the tray unit 10 at the respective ends.

As best shown in FIGS. 1 and 2, the adjustable tray unit 10 also includes a generally upstanding product follower member 26 mounted with respect to the base 16 for movement between the front end portion 12 and the rear end portion 14. As seen, the base 16 includes a longitudinal slot 28 extending therethrough from the rear end 14 toward but spaced a short distance from the front end 12. The follower member 26 is provided with a depending platform 27 which is slidably mounted to move along the slot 28. The platform 27 is provided with lateral wings 29 which engage below the base 16 thereby preventing the follower from leaving the slot 28. At the rear end of the slot 28 the slot is widened to form an enlarged space 28A through which the follower 26 may be removed when desired.

A biasing member 30 is operatively connected between the base 16 and the follower member 26 to bias the follower member 26 towards the front end portion 12. The biasing member 30 is a roll spring secured at one end by a rivet 32 to the base 16 forward of the slot 28 and at its other end in a housing 34 integrally formed on the platform 27 of the follower 26 so that the biasing member 30 passes below the follower member 26 and so that the biasing member 30 will provide biasing forces on the product follower 26 after being manually moved towards the posts 24 at the rear end portion 14 of the base. In this manner product may be arranged between the vertical walls 20 and follower 26 along the length of the tray.

A tab 38 is integral with the follower 26. Follower 26 is stopped at the forward end of tray slot 28 by tab 38. In addition, the upper surface of the base 16 is provided with a pair of ribs 36 along its longitudinal edges into which the product follower 26 is then guided in its movement.

The side walls 18 are fully extendible respectively to the right and left of the base 16 as illustrated in FIG. 3. To enable such adjustment, an assembly, generally designated 40, is provided at each end of the tray unit 10 on its underside. The adjusting assembly 40 is associated with the base 16 and the side walls 18 to allow the horizontal length of the tray unit 10 to be laterally adjusted to accommodate merchandise products of varying widths.

Each adjusting assembly comprises a freely rotatable pinion 42 mounted at each end of the base, the pinions being freely rotatable about an axis perpendicular to the plane of the base. Meshing with each of the pinions 42 are a pair of racks 44 which lie parallel to the plane of the base 16. One of the racks 44 is integrally formed with a respective one of the walls 18 while the other rack is integrally formed with the opposing wall 18 of the tray. The racks 44 are each stabilized by passing through a narrow slot 46 formed along the lateral edge at the bottom of base 16.

Extending perpendicularly to the respective end of each of the side walls 18 at right angles thereto and parallel to the plane of the base 16. The flat face of each rack 44 is provided on one surface with a series of raised indentations 48 which coact with the slots 46 as detents or stops to permit the side walls 18 to be indexed laterally relative to the base 16 at pre-selected positions thereof.

At the front end 12 of the tray, the pinion 42 of the adjusting assembly 40 is mounted on the fixed rivet 32 to which the biasing member 30 or spring coil is also secured as seen clearly in FIG. 2. The assembly 40 at the rear end of the tray, while identical to that of the front end is mounted on a fixed pivot 32A which has no auxiliary function. Each adjusting assembly 40 also includes washers 50 between which the pinion 42 and the lower end of the rivets 32 and 32A are sandwiched. The washers 50 are of such diameter that they, at least in part, overlap and are in frictional contact with the respective pair of the toothed portion of racks 44. Thus, each washer 50 provides sufficient retaining force to maintain the racks in intermeshing engagement with the pinion while allowing relative rotation of the toothed wheel 42.

In use, to adjust the width of the tray unit 10, the side walls 18 are manually pulled away from each other (toward the right and left respectively) causing the toothed racks 44 to slide through the channel slots 46 as the toothed pinions 42 rotate via their intermeshing engagement with the former. The raised indentations 48 allow the racks 44 to be located at preselected positions with respect to the base 16 as the raised indentations 48 engage the inner surfaces of the slots 46.

Upon achieving the maximum adjustable width possible for the side walls 18, as shown in FIG. 3, the product to be sold may then be easily inserted in the tray, placing a number of such products between the front walls 20 and the follower 26 which is pushed to the rear 14. Thereafter, the width of the tray 10 may be decreased by manually pressing the side walls 18 toward each other causing the racks 44 to again move through the slots 46 in a counter rotational direction. Thus, the width of the tray unit 10 can be effectively adjusted through a range of preselected positions with respect to the base 16 in order to allow merchandise products of various widths to be accommodated therein. Preferably, the products are inserted between the side walls when the side walls are in their most extended position although this is not always necessary. Thereafter, the side walls can be simultaneous closed on the product's edges so as to hold the product in stable, secure position.

FIGS. 1 and 2 illustrates the tray 10 in an empty condition, with the follower member 26 located at the front end of the tray. This condition is achieved when the tray unit 10 is completely emptied of the products or when only one of the products remains therein. When this condition is observed, the stocking employee will know that the particular product has been exhausted and that refilling is now necessary.

After the tray 10 is filled with merchandise products to the extent desired, it is ready for display to the consumer. As the customer selects the first packet in the tray, the remaining merchandise within the tray will be successively pushed toward the front end portion by the action of the biasing spring 30 until all of the product is depleted. The stocking employee may thereafter readily insert fresher merchandise products behind whatever merchandise may be remaining in the tray unit 10. Thus, it will be appreciated that the tray 10 greatly facilitates stock rotation.

It will be appreciated that the relative dimensions for the base 16, the side walls 18, and the attendant mechanism may be varied in order to provide tray units of various dimensions to merchandise many types of product without departing from the spirit and scope of the present invention.

In the present embodiment, the tray unit 10 is generally rectangular in shape and the components are preferably molded, (except for the biasing spring 30) from a durable polymeric material, such as a hard plastic. However, it is understood that other materials and fabrication methods may be employed. For example, the tray could have any polygonal or curved configuration and be formed from a durable metal material.

Figure 4:
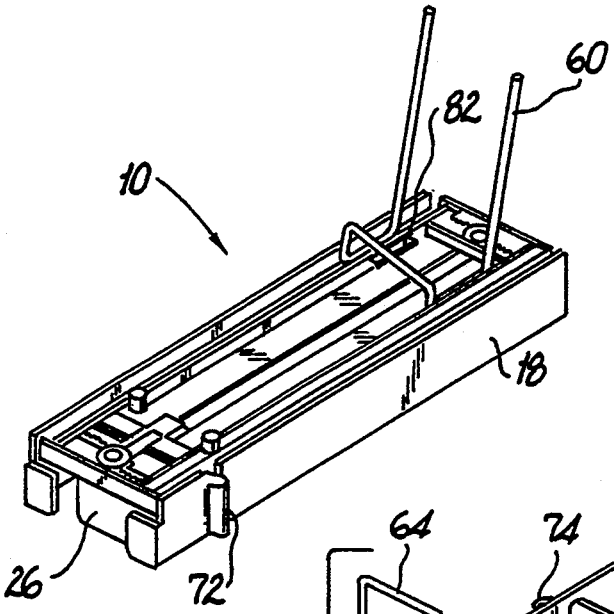
FIG. 4 is a perspective view showing the internal stage in the assembly of a pair of trays.
Figure 5:
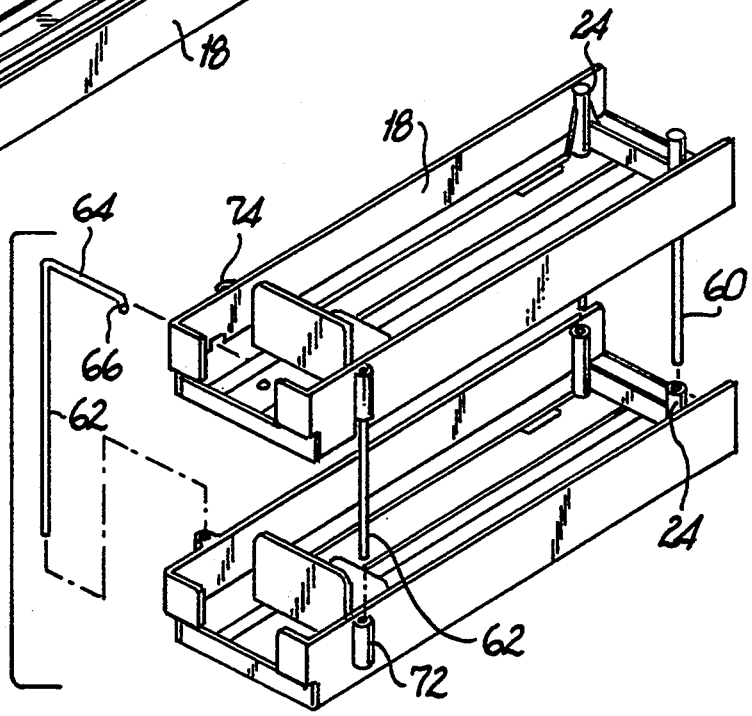
FIG. 5 is a perspective view of the final stage in the assembly of a pair of trays.
Figure 6:
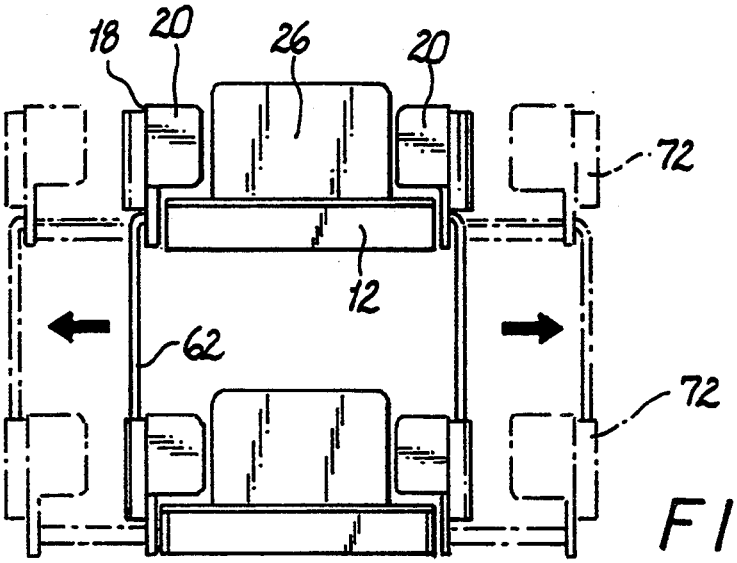
FIG. 6 is an end view of the assembly seen in FIG. 1.

The trays illustrated in FIGS. 1–3 lend themselves to easy stacking one above the other. FIGS. 4–6 illustrate just how a plurality of adjustable trays 10 may be stacked so as to display several different or similar products. To effect the stacking, the tray units further include a plurality of stacking members for connecting the individual tray units 10 together into a vertical orientation.

The stacking members first include a U-shaped support 60 located at the rear of the tray and a second pair of separate stem supports 62 located on the front end of the tray.

Each of the front stem supports 62 is formed of a generally L-shaped rigid wire member the short leg 64 having a crimp 66 at its end. The straight end is adapted to be inserted in a socket-like member 72 molded integrally on the exterior surface of the side wall 18, while the bent portion 66 is inserted in hole 74 formed below the socket member of the upper tray and the crimped end 66 fits into a channel 76 in the bottom side floor of the base 16 (FIG. 3).

The U-shaped support 60 is formed of a single rigid wire bent along the length of its two arms to form a twisted base 80 (FIG. 4) adapted to fit between the dependent side ridges 39 formed in the bottom of the base 16. Because of the rigidity of the wire and the twist of the U-shape, the base 80 is resiliently biased to fit in tight arrangement between the ridges 39, and tabs 82. Twisted base 80 is prevented from moving forward by barbed ramps 90 located on side ridges 39 in bottom of base 16.

The L-shaped wire stem supports 62 are then inserted into respective slots 76 through holes 74 on side wall 18 until they properly sit there.

Guide all 4 straight wires into post 24 and socket members 72 simultaneously and seat wire on bottom of post 24 and socket members 72. The fully assembled condition of the second embodiment is illustrated in FIG. 6.

As shown in phantom in FIG. 6, the width of the stacked trays may be adjusted in the same manner as described earlier. Since the rear U-shaped stems are attached to the base and the L-shaped members are attached to the side walls, the two may be easily moved relative to each other.

Preferably, the L-shaped wire members 62 and the U-shaped wire members 60 are formed from steel. However, it is understood that other materials, such as a high strength aluminum, are suitable for the wire members. It will also be appreciated that the relative dimensions of the wire members could be varied. For example, the wire members could be shorter or longer depending on the product mix to attain the necessary height between the trays.

It will also be appreciated that the combination of the features of the expandable tray assembly automatically maintains an organized and properly positioned stock of differing merchandise (not shown) which are readily recognized and removed by the consumer without resulting in disorganization or improper positioning of the merchandise products.

From the foregoing description, it can be seen that the present invention comprises an improved tray unit and an expandable tray unit assembly for storing and displaying merchandise products. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. An adjustable tray unit for use in storing and displaying products, said tray unit comprising:

(a) a main body for supporting a plurality of products, said main body having a front end portion, a rear end portion, a base for supporting said product, and a pair of side walls disposed at right angles to said base, each of said side walls having first and second ends;

(b) adjusting means associated with said base and said side walls to adjust the horizontal width of said body so as to accommodate products of various widths, said adjusting means comprises:

(c) a first pair of toothed shafts, each of said first toothed shafts being respectively supported from said first end of each of said pair of side walls at right angles thereof;

(d) a second pair of toothed shafts, each of said second toothed shafts being respectively supported from said second end of each of said pair of side walls at right angles thereof;

(e) a pair of toothed wheels mounted to said base for relative rotation thereof, each of said toothed wheels being respectively in simultaneous intermeshing engagement with said first and second pair of toothed shafts;

(f) a first pair of washers having first and second sides, said second side of each of said first washers being respectively in frictional contact with said first and second pair of toothed shafts;

(g) a second pair of washers, each of said second washers being respectively fastened to said second side of each of said first washers;

whereby rotation of said pair of toothed wheels in a first direction causes said side walls to translate away from said base and subsequent rotation of said pair of toothed wheels in a second direction causes said side walls to translate towards said base so as to allow products of various lengths to be accommodated on said tray.

2. The adjustable tray unit as set forth in claim 1, wherein said base further includes a first pair of channel members at said front end portion and a second pair of channel members at said rear end portion, and wherein said first and second pairs of toothed shafts extend respectively through said first and second pairs of channel members for relative translation therein as said pair of toothed wheels are rotated in said first and second directions.

3. The adjustable tray unit as set forth in claim 2, further including means for retaining said first and second pairs of toothed shafts within said respective channels at preselected positions.

4. The adjustable tray unit as set forth in claim 1 including stop means at said front end portion of said main body for preventing said products from exiting said tray unit; a generally upstanding product follower member slidably mounted with respect to said base for movement between said rear end portion and said front end portion of said main body; and biasing means operatively engaged between said base and said product follower member to bias said product follower member toward said front end portion of said main body.

5. The adjustable tray unit as set forth in claim 4, wherein said base includes a longitudinal slot extending therethrough and said product follower is slidably mounted along said slot.

6. The adjustable tray unit as set forth in claim 4, wherein said stop means comprises a pair of upstanding members, each of said upstanding members extending respectively from said first end of each of said side walls.

7. The adjustable tray unit as set forth in claim 4, wherein said biasing means comprises a roll spring including a first end fastened to said base and a second end forming a spring coil secured to said product follower member.

8. The adjustable tray unit as set forth in claim 7, wherein said product follower comprises a housing portion, and wherein said spring coil is secured within said housing portion.

9. An expandable tray assembly for use in storing and displaying products, said tray assembly comprising:

a plurality of adjustable trays for supporting a plurality of products, each of said plurality of trays comprising:

(a) a main body having a front end portion, a rear end portion, a base for supporting said product and a pair of side walls disposed at right angles to said base, each of said side walls having first and second ends;

(b) stop means at said front end portion of said main body for preventing said products from exiting said tray assembly;

(c) a generally upstanding product follower member slidably mounted with respect to said base for movement between said rear end portion and said front end portion of said main body;

(d) biasing means operatively engaged between said base and said product follower to bias said product follower toward said front end portion of said main body;

(e) adjusting means associated with said base and said pair of side walls to adjust the width of said tray assembly so as to accommodate products of various sizes; and (f) said tray assembly including stacking means for securing trays one on top of another with vertical space therebetween for said products.

10. The expandable tray assembly as set forth in claim 9, wherein said stacking means of each of said plurality of trays comprises:

(a) a first pair of tubular stem members secured perpendicular to said base at said rear end portion and a second pair of tubular stem members, each one of said second pair of tubular stem members being secured in parallel relationship to a respective side wall at said first end thereof;

(b) a plurality of generally L-shaped wire members having first and second ends adapted for insertion into said second pair of tubular stem members; and (c) a plurality of generally U-shaped wire members having a first pair of legs, a second pair of legs in perpendicular relation to said first pair of legs, and a transverse portion connecting said second pair of legs, said first pair of legs being adapted for insertion into said first pair of tubular stem members.

11. The expandable tray assembly as set forth in claim 9, wherein said base of each of said plurality of trays includes a longitudinal slot extending therethrough and said product follower member is slidably mounted along said slot.

12. The expandable tray assembly as set forth in claim 9, wherein said stop means of each of said plurality of trays comprises a pair of upstanding members, each upstanding member extending respectively from said first end of each of said side walls.

13. The expandable tray assembly as set forth in claim 9, wherein said biasing means of each of said plurality of trays comprises a roll spring including a first end fastened to said base and a second end forming a spring coil secured to said product follower member.

14. The expandable tray assembly as set forth in claim 9, wherein said adjusting means of each of said plurality of trays comprises:

(a) a first pair of toothed shafts each being respectively supported from said first end of each of said pair of side walls at right angles thereof;

(b) a second pair of toothed shafts each being respectively supported from said second end of each of said pair of side walls at right angles thereof;

(c) a pair of toothed wheels mounted to said base for relative rotation thereof, each of said toothed wheels being respectively in simultaneous intermeshing engagement with said first and second pair of toothed shafts;

(d) a first pair of washers having first and second sides, said second side of each of said first washers being respectively in frictional contact with said first and second pair of toothed shafts; and (e) a second pair of washers each being respectively fastened to said second side of each of said first pair of washers;

whereby rotation of said pair of toothed wheels in a first direction causes said side walls to translate away from said base and subsequent rotation of said pair of toothed wheels in a second direction opposite said first direction causes said side walls to translate towards said base so as to allow products of various lengths to be accommodated on said tray.

15. The expandable tray assembly as set forth in claim 14, wherein said base of each of said plurality of trays further includes a first pair of channel members at said front end portion and a second pair of channel members at said rear end portion, and wherein said first and second pairs of toothed shafts extend respectively through said first and second pairs of channel members for relative translation therein as said pair of toothed wheels are rotated in said first and second directions.

16. The expandable tray assembly as set forth in claim 15, further including means for retaining said first and second pairs of toothed shafts within said respective channels at preselected positions.

* * * * *